US008777589B2

(12) United States Patent
Berwanger et al.

(10) Patent No.: US 8,777,589 B2
(45) Date of Patent: Jul. 15, 2014

(54) VALVE ACTUATION SYSTEM FOR A SUCTION VALVE OF A GAS COMPRESSOR FOR REFRIGERATION EQUIPMENT

(75) Inventors: Egidio Berwanger, Joinville SC (BR); Humberto Ferreira da Câmara, Joinville SC (BR); Edmar Baars, Joinville SC (BR); Ingwald Vollrath, Joinville SC (BR)

(73) Assignee: Whirlpool S.A., Sao Paulo (BR)

( * ) Notice: Subject to any disclaimer, the term of this patent is extended or adjusted under 35 U.S.C. 154(b) by 227 days.

(21) Appl. No.: 13/131,484

(22) PCT Filed: Nov. 26, 2009

(86) PCT No.: PCT/BR2009/000386
§ 371 (c)(1),
(2), (4) Date: Sep. 6, 2011

(87) PCT Pub. No.: WO2010/060169
PCT Pub. Date: Jun. 3, 2010

(65) Prior Publication Data

US 2011/0311382 A1 Dec. 22, 2011

(30) Foreign Application Priority Data

Nov. 27, 2008 (BR) ..... 0806059

(51) Int. Cl.
*F04B 39/10* (2006.01)
*F04B 49/00* (2006.01)
*F04B 53/10* (2006.01)

(52) U.S. Cl.
USPC ..... 417/298; 417/294; 417/571

(58) Field of Classification Search
USPC ..... 417/294, 298, 415, 454, 569, 571
See application file for complete search history.

(56) References Cited

U.S. PATENT DOCUMENTS

| | | | | |
|---|---|---|---|---|
| 1,365,272 | A * | 1/1921 | Reeder | 417/294 |
| 1,591,393 | A * | 7/1926 | McAllister | 417/294 |
| 2,107,644 | A * | 2/1938 | Ohmart | 417/294 |
| 2,132,070 | A * | 10/1938 | Hoerbiger et al. | 417/53 |

(Continued)

FOREIGN PATENT DOCUMENTS

| | | |
|---|---|---|
| FR | 639.046 | 6/1928 |
| GB | 366253 | 2/1932 |

OTHER PUBLICATIONS

International Search Report mailed Mar. 3, 2010 for International application No. PCT/BR2009/000386.

(Continued)

*Primary Examiner* — Peter J Bertheaud
(74) *Attorney, Agent, or Firm* — Fay Sharpe LLP

(57) ABSTRACT

A system for actuation in an admission valve of a gas compressor including an admission valve being configured to allow the input of gas inside the cylinder upon the axial movement of the piston in a first axial direction; and a discharge valve configured to allow the output of gas from inside the cylinder upon the axial movement of the piston in a second axial direction opposite to the first axial direction. The system includes at least one actuator element, operatively associated with the admission valve, capable of keeping the admission valve open when the electric motor stops and starts-up. The actuator element is also capable of allowing opening and closing of the admission valve upon the regime of work of the electric motor. The present development also refers to refrigeration equipment which includes the above-mentioned gas compressor.

6 Claims, 12 Drawing Sheets

(56) References Cited

U.S. PATENT DOCUMENTS

| | | | | |
|---|---|---|---|---|
| 2,164,405 | A * | 7/1939 | Hintze | 417/281 |
| 2,364,038 | A * | 11/1944 | Touborg | 417/294 |
| 3,653,783 | A * | 4/1972 | Sauder | 417/298 |
| 4,778,360 | A | 10/1988 | Ikeda et al. | |
| 2004/0086406 | A1 | 5/2004 | Lee | |
| 2007/0272890 | A1 | 11/2007 | Kopecek et al. | |
| 2007/0295926 | A1 | 12/2007 | Kopecek et al. | |

OTHER PUBLICATIONS

Written Opinion mailed Mar. 3, 2010 for International application No. PCT/BR2009/000386.

Reply to Written Opinion dated Sep. 27, 2010 for International application No. PCT/BR2009/000386.

International Preliminary Report on Patentability mailed Apr. 6, 2011 for International application No. PCT/BR2009/000386.

* cited by examiner

VALVE ACTUATION SYSTEM FOR A SUCTION VALVE OF A GAS COMPRESSOR FOR REFRIGERATION EQUIPMENT

The present invention refers to a system for actuation in an admission valve of a gas compressor. More particularly, the present invention refers to a system capable of allowing start-up in conditions where the suction pressure (input) and discharge pressure (output) of gas in a gas compressor are not equalized.

The present invention also refers to a gas compressor which comprises the abovementioned system.

The present invention further refers to a refrigeration equipment which comprises the abovementioned gas compressor.

BACKGROUND OF THE INVENTION

Currently, it is common to use sets of piston (plunger) and cylinder driven by electric motors for application, for instance, to gas compressors of refrigeration equipments, such as industrial/commercial/domestic refrigerators, freezers and air-conditioning devices.

In these types of compressors, the electric motor drives the piston which, in turn, moves inside the cylinder in an axial swing (back and forth) movement, so as to compress and decompress the gas. Normally, in the header of this cylinder, valves for suction and discharge of gas are positioned, which valves respectively regulate the input of gas at low pressure and the output of gas at high pressure from inside the cylinder. The axial movement of the piston inside the cylinder of the compressor compresses the gas admitted by the suction valve, raising its pressure and discharging it through the discharge valve to a high pressure zone. Alternatively, there are configurations of compressors in which the suction valve is positioned on the piston itself.

FIG. 1 illustrates a graph that relates the input pressure (suction) of a gas compressor to its output pressure (discharge), wherein curve ER represents a standard curve of the refrigeration equipment and curve C represents a standard curve of the compressor operating isolated from any refrigeration equipment or system. It is worth noting that curve ER represents the behavior of the refrigeration equipment in the pull down period of the compressor (time so that the internal temperature of the refrigeration equipment decreases until it reaches a pre-established temperature or time passed from the start-up of the compressor until it reaches the situation of regime).

Line P represents the pressure of equalization of the system in view of the gas cargo and the room temperature. It is worth noting that in line P, the suction pressure (input) and discharge pressure (output) are the same. Thus, if the relation between the suction pressure and the discharge pressure is not compatible with line P upon the start-up of the compressor, it will be under condition of blocked rotor, that is, the compressor will not be able to start-up even being energized and, consequently, the refrigeration equipment will not work as expected.

In curve ER, it can be observed that the discharge pressure quickly increases until it reaches approximately 11 bar, whereas the suction pressure decreases at lower rates until approximately 3.5 bar. From this point (first inflexion point in the curve), the discharge pressure increases at lower rates up to a maximum value (second inflexion point), around 14 bar, to, then, (third inflexion point), slowly decrease until a value of permanent regime. In this period, the suction pressure starts quickly decreasing until a value of approximately 1.3 bar, slowly increasing again with the discharge pressure up to a peak of approximately 1.9 bar, from which it starts softly decreasing until a condition of balance is achieved (regime).

In the condition in which curve ER intercepts curve C, there is the undesired situation when the compressor overturns, once the electric motor does not have enough torque to provide the proper operation of the compressor. This interception (intersection) may occur between the moment the compressor starts-up and the first inflexion point of curve ER. After overturning, the motor stops working and the relation between the suction pressure and discharge pressure does not obey line P and, therefore, the motor rotor will be blocked, and the compressor will not be able to start-up. Starting-up the compressor will only be possible when the suction pressure and the discharge pressure are equalized, that is, when the relation between these pressures is in accordance with line P.

Therefore, a problem commonly noted in the electric motors of compressors is when they overturn upon pull-down. Moreover, under this condition of blocked rotor, the thermal protector of the electric motor will be requested, which is evidently an undesired situation.

Additionally, when the supply of electric power to the compressor is shortly interrupted, the suction pressure will not be equalized with the discharge pressure (condition established by line P) and, consequently, the compressor will not be able to start-up. Because of that, the thermal protector of the electric motor will be requested, and it will be necessary to wait a certain time so that the suction and discharge pressures are equalized.

Thus, in view of all the problems abovementioned, the electric motors for compressors are currently over-dimensioned, so as to place curve C far from curve ER so that their operation is not impaired and, therefore, it is necessary to use a motor with higher capacity, more expensive, which also occupies a larger space (over-dimensioned motor to avoid the intersection between curves C and ER).

Furthermore, considering that the compressors are normally positioned over springs, it is common to observe their excessive vibration and a high level of noise resulting mainly from the impact of the motor on the casing, upon its turning-off (stop), once, as the movement of the piston does not immediately stop when it is required to stop due to the inertial force, it keeps trying to compress the gas. However, after a certain time, this inertial force is no longer enough to provide the opening/closing of the valves. This way, the gas is retained inside the cylinder and, therefore, its compression is not appropriately and softly performed, causing the compressor to undesirably vibrate. Because of that, many compressors have casings with over-dimensioned external dimensions, to place them as far as possible of the motors, in order to avoid the impact thereon. However, this over-dimensioning of the casing makes it difficult to transport the compressor, apart from requiring a larger space for its installation inside the refrigeration equipment. Furthermore, the space created between the casing and the motor makes it easier to break internal pieces, parts, and components of the compressor, when it is transported.

Purposes of the Invention

One purpose of the invention is to provide a system capable of actuating on an admission valve of a gas compressor of a refrigeration equipment, in order to prevent or release the compression and decompression of the gas so as to avoid the need of over-dimensioning its motor (the compressor project may be focused for the region of curve ER after the third inflexion point).

Another purpose of the invention is to provide a system capable of preventing the compressor from overturning during its pull-down period.

Also, another purpose of the invention is to provide a system capable of avoiding the condition of blocked rotor of the electric motor to allow starting-up the compressor and decrease the frequency of request for the thermal protector of said motor.

It is also a purpose of the invention to provide a system capable of softly stopping the compressor, so as to avoid its vibration, undesired noises and damages to internal components, without the need of over-dimensioning its casing.

A further purpose of the invention is to provide a gas compressor that comprises the abovementioned system.

Another purpose of the invention is also to provide a refrigeration equipment which comprises the abovementioned gas compressor.

BRIEF DESCRIPTION OF THE INVENTION

The purposes of the present invention are met by supplying a system for actuation in an admission valve of a gas compressor comprising at least: one set formed by a cylinder and a piston; one electric motor, operatively associated with said set, capable of providing an axial movement of the piston to compress the gas inside the cylinder, the admission valve being configured to allow the input of gas inside the cylinder upon the axial movement of the piston in a first axial direction; and one discharge valve configured to allow the output of gas from inside the cylinder upon the axial movement of the piston in a second axial direction opposite to the first axial direction. The system comprises at least one actuator element, operatively associated with the admission valve, capable of keeping the admission valve open when the electric motor stops and starts-up. The actuator element is also capable of allowing opening and closing of the admission valve upon the regime of work of the electric motor.

The purposes of the present invention are also achieved by the supply of a gas compressor which comprises at least one set formed by a cylinder and a piston; one electric motor, operatively associated with said set, capable of providing an axial movement of the piston to compress the gas inside the cylinder; one admission valve configured to allow the input of gas inside the cylinder upon the axial movement of the piston in a first axial direction; and one discharge valve configured to allow the output of gas from inside the cylinder upon the axial movement of the piston in a second axial direction, opposite to the first axial direction. The gas compressor also has a system for actuation in its admission valve which comprises at least one actuator element, operatively associated with the admission valve, capable of keeping the admission valve open when the electric motor stops and starts-up. Said actuator element is also capable of allowing opening and closing of the admission valve upon the regime of work of the electric motor.

The purposes of the present invention are also achieved by the supply of a refrigeration equipment having a gas compressor comprising at least one set formed by a cylinder and a piston; one electric motor, operatively associated with said set, capable of providing an axial movement of the piston to compress the gas inside the cylinder; one admission valve configured to allow the input of gas inside the cylinder upon the axial movement of the piston in a first axial direction; and one discharge valve configured to allow the output of gas from inside the cylinder upon the axial movement of the piston in a second axial direction, opposite to the first axial direction. The refrigeration equipment also has a gas compressor with a system for actuation in its admission valve comprising at least one actuator movement, operatively associated with the admission valve, capable of keeping the admission valve open when the electric motor stops and starts-up. Said actuator element is also capable of allowing opening and closing of the admission valve upon the regime of work of the electric motor.

BRIEF DESCRIPTION OF THE DRAWINGS

The present invention will be further described in more details, with reference to the attached drawings, in which.

DETAILED DESCRIPTION OF THE FIGURES

Set of Piston and Cylinder Driven by a Motor

Figure 1:
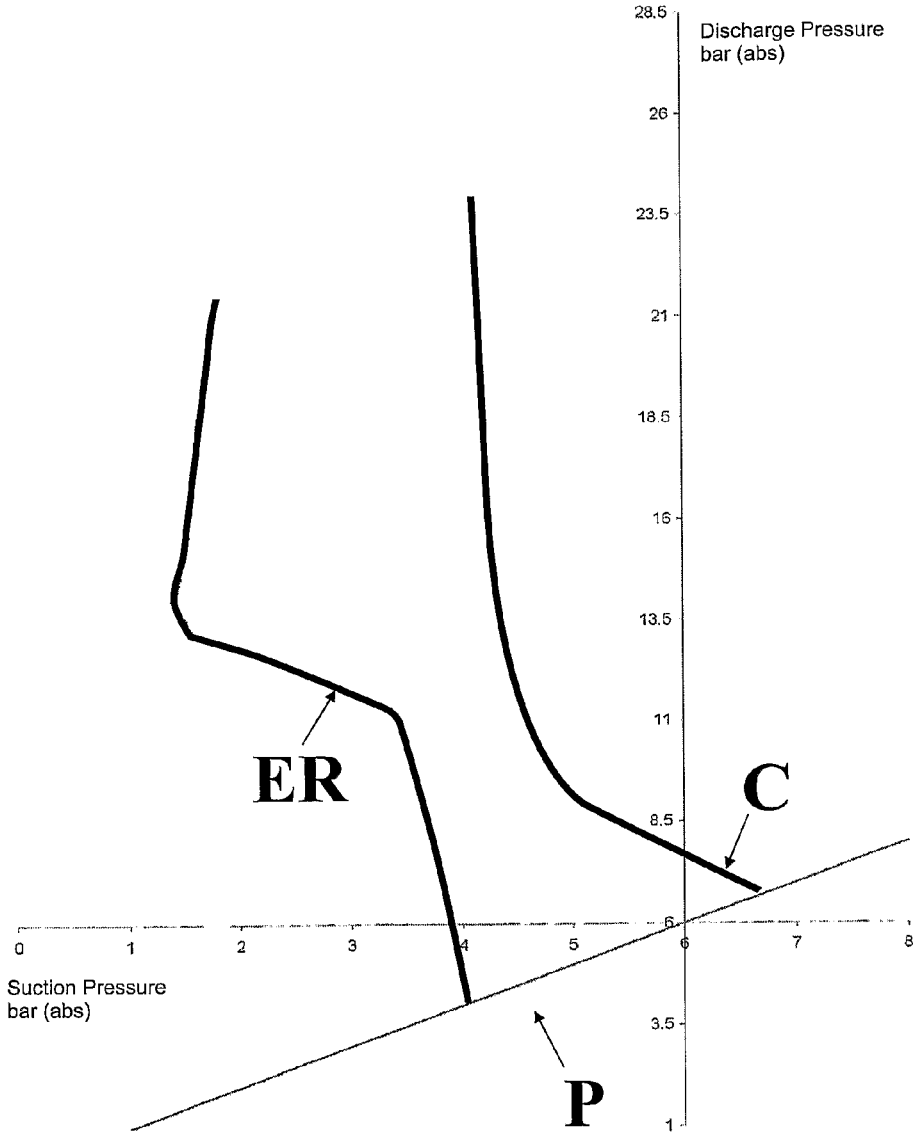
FIG. 1—is a graphic which illustrates curves that relate the suction pressure and discharge pressure of a gas compressor.
Figure 2:
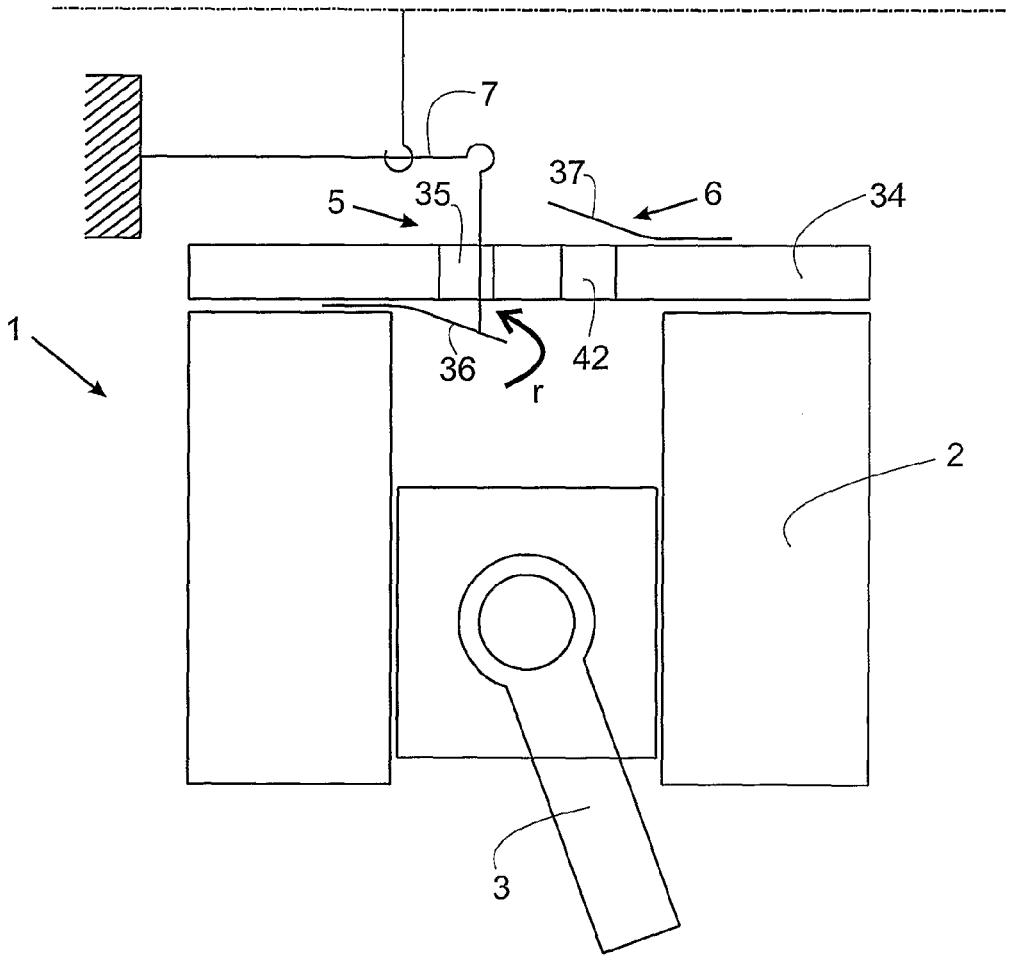
FIG. 2—represents a partial schematic view of an internal portion of a gas compressor, the object of the present invention.
Figure 3:
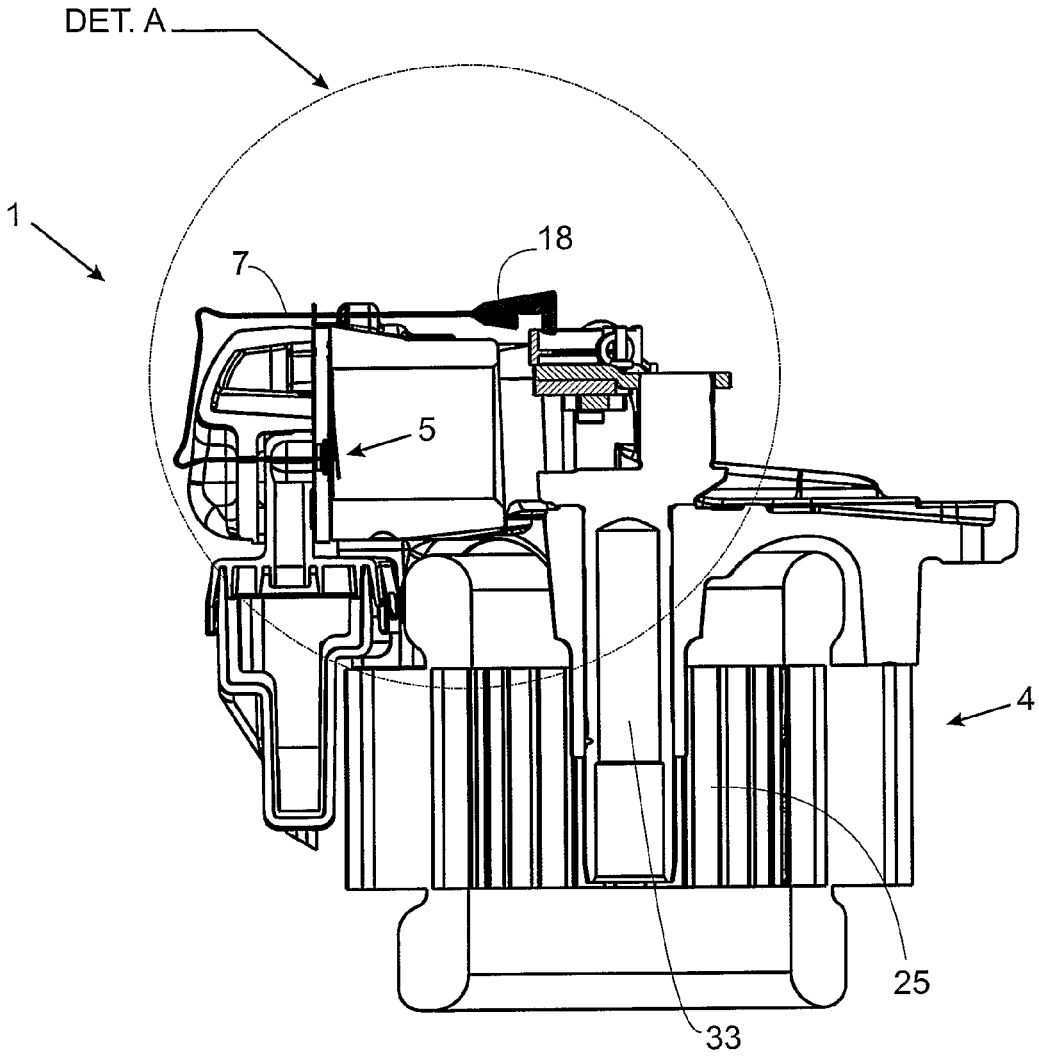
FIG. 3—represents a side sectional view of a gas compressor that comprises a system for actuation in its admission valve according to a first preferred embodiment of the present invention.

FIG. 2 illustrates a partial schematic view of an internal portion of a gas compressor 1 according to the present invention. The gas compressor 1 comprises a set formed by a cylinder 2 and a piston 3 operatively associated with an electric motor 4 capable of providing an axial movement of the piston 3, thus allowing the compression of the gas inside the cylinder 2.

Preferably, this gas consists of a cooling fluid, such as SUVA MP66 or SUVA MP39 produced by manufacturer Dupont. In other applications of the set of cylinder 2 and piston 3, it is possible to operate with other types of fluid, for instance, water. The gas compressors can be of plunger type (ex: linear course), spinning type or any other type suitable for this application.

The electric motor 4 comprises at least one rotor 25, one shaft 33 and one coil associated with each other. The coil of the electric motor 4, when electrically fed, is capable of providing the drive (rotation) of the rotor 25 and, consequently, of the shaft 33. This rotation of the rotor 25 allows the axial displacement of the piston 3 inside the cylinder 2.

The cylinder 2 comprises a plate of valves in its upper end, also called header 34, having an admission valve 5 configured to allow the input of gas at low pressure inside the cylinder 2, upon the axial movement of the piston 3 in a first axial direction. Preferably, the admission valve 5 consists of a set formed by a first hole 35 and a first plate 36. This first plate 36 is capable of moving towards reaching the first hole 35 (direction of arrow r indicated in FIG. 2) upon the axial movement of the piston 3 in the first axial direction, and, capable of moving as to get distant from the first hole 35 upon the axial movement of the piston 3 in a second axial movement, opposite to the first axial direction. Therefore, the first plate 36 plays the role of closing or opening the first hole 35 so as to prevent or allow the admission (suction or passage) of gas inside the cylinder 2, respectively.

The header 34 also has a discharge valve 6 configured to allow the output of gas at high pressure from inside the cylinder 2 upon the axial movement of the piston 3 in a second axial direction, opposite to the first axial direction. Also preferably, the discharge valve 6 consists of a set formed by a second hole 42 and a second plate 37.

Optionally, other types and constructive arrangements of valves could be used, as long as suitable for this application.

This way, the piston 3 moves inside the cylinder 2 in a swing (back and forth) movement, exercising the compression of the gas admitted inside the cylinder 2 by the admission valve 5, up to the point in which this gas can be discharged to the side of high pressure, through the discharge valve 6.

The operation of the gas compressor 1 comprises three main stages:

i) Start-up: when the electric motor 4 is driven, the rotation of the rotor 25 gradually increases until it reaches a rotation of work.

ii) Regime of work: when the gas compressor 2 operates under a substantially stable condition (regime). Preferably, in this condition, the rotor 25 and the shaft 33 rotate at about 3000 RPM.

iii) Stop: when the electric motor 4 is deactivated, the rotation of the rotor 25 gradually decreases until it reaches zero.

The system for actuation in an admission valve of a gas compressor, the object of the present invention, actively works on stages i) and iii), that is, when the gas compressor 1 starts-up or stops (blocking of the compression and decompression of gas). On stage ii), the system passively works, allowing the regular operation/functioning of the gas compressor 1 (release of the compression and decompression of gas).

Such system comprises at least one actuator element 7 operatively associated with the admission valve 5. The actuator element 7 is capable of keeping the admission valve 5 open when the electric motor 4 stops and starts-up. Moreover, the actuator element 7 is capable of allowing opening and closing the admission valve 5 upon the regime of work of the electric motor 4.

Preferably, the actuator element 7 consists of a (straight, curved or bent) rod capable of being pulled or pushed to allow the movement of the first plate 36 towards reaching the first hole 35 or its movement to get far from the first hole 35, respectively.

Thus, when the compressor is under its regular regime (regime of work), the torque requested by its motor is a normal torque of work, corresponding to a regular rotation of work (for instance, approximately 3,500 RPM). However, during pull down or under any other critical condition in which a higher torque is required, the rotation of the compressor motor will decrease in relation to the regular rotation of work. If this rotation decreases up to a certain value (for instance, approximately 3,000 RPM) corresponding to a value of overturning torque, the compressor would tend to overturn (stop). Therefore, the system of the present invention is configured to actuate in this situation, in which the rotation of the motor corresponds to the overturning torque, allowing the compressor to resume its regular rotation of work (regime of work) so as to overcome the critical conditions. This way, the system proposed by the present invention prevents the compressor from overturning, that is, the system allows the compressor to function normally, even upon these critical conditions. Because of this, it is not necessary either that the compressor motor be over-dimensioned.

Additionally, the system decreases the frequency of request for the thermal protector of the motor of the gas compressor 1 when the supply of electric power is shortly interrupted, preventing it from burning, once the condition of blocked rotor is avoided.

Furthermore, the system provides a soft stop of the gas compressor 1, so as to avoid its vibration, undesired noises and damages to internal components, since the gas is no longer retained and confined inside the cylinder 2 because the admission valve 5 remains open during the stop of the gas compressor 1.

Next, some preferred ways to control the actuator element 7 will be described, so as to meet the purposes of the present invention.

First Preferred Embodiment

As it can be observed in FIGS. 3 to 7, in this first preferred embodiment, the system for actuation further comprises at least one elastic element 8, one semi-arch element 9 and one auxiliary element 18 which are all operatively associated. The auxiliary element 18 is also operatively associated with the actuator element 7.

Figure 7:
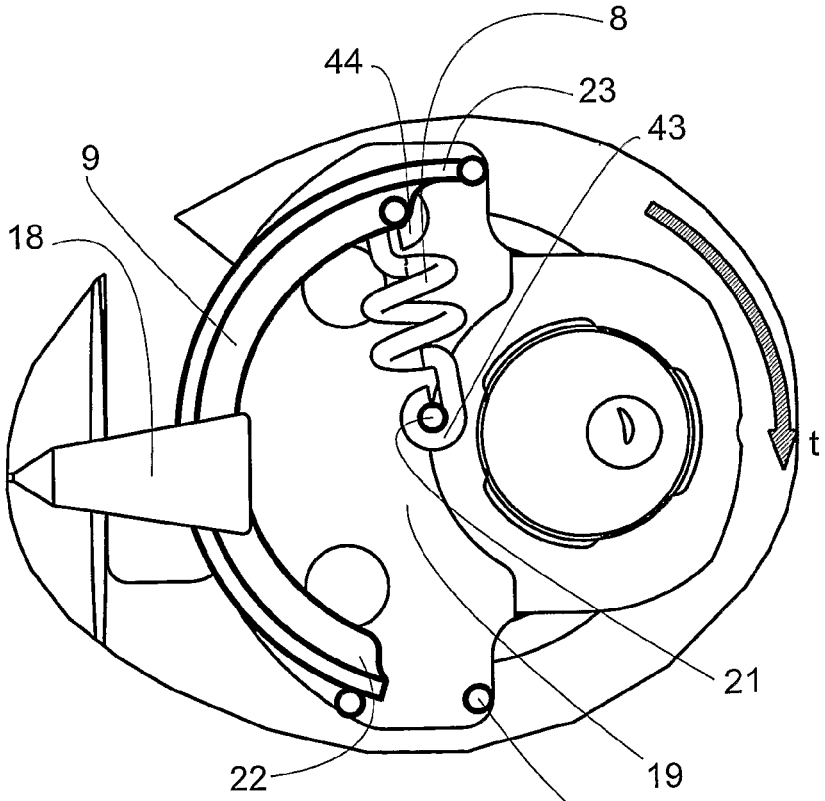
FIG. 7—represents an enlarged view of detail C indicated in FIG. 6.
Figure 8:
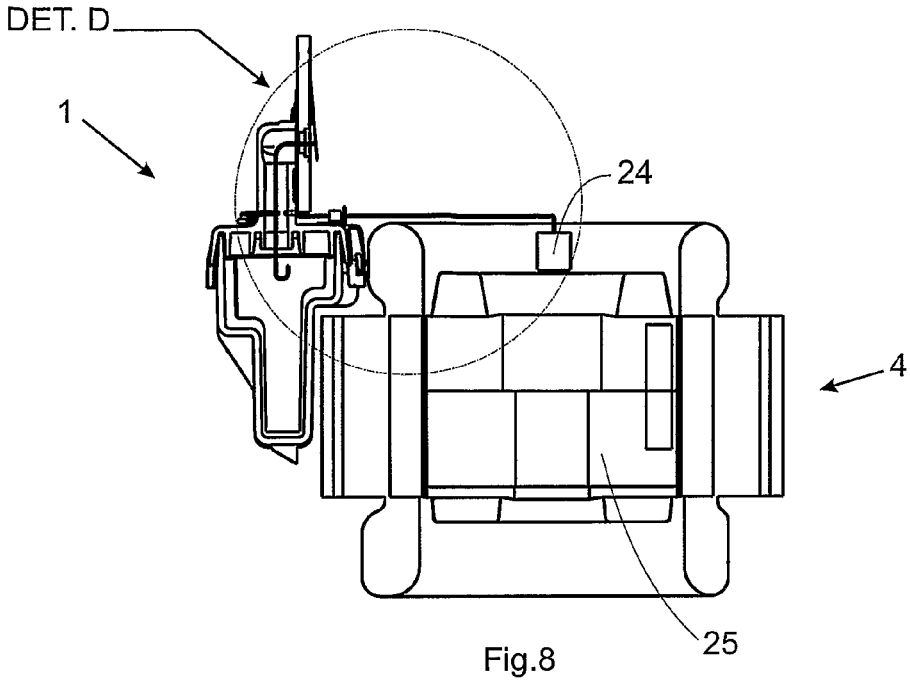
FIG. 8—represents a side sectional view of a gas compressor that comprises a system for actuation in its admission valve according to a second preferred embodiment of the present invention.
Figure 9:
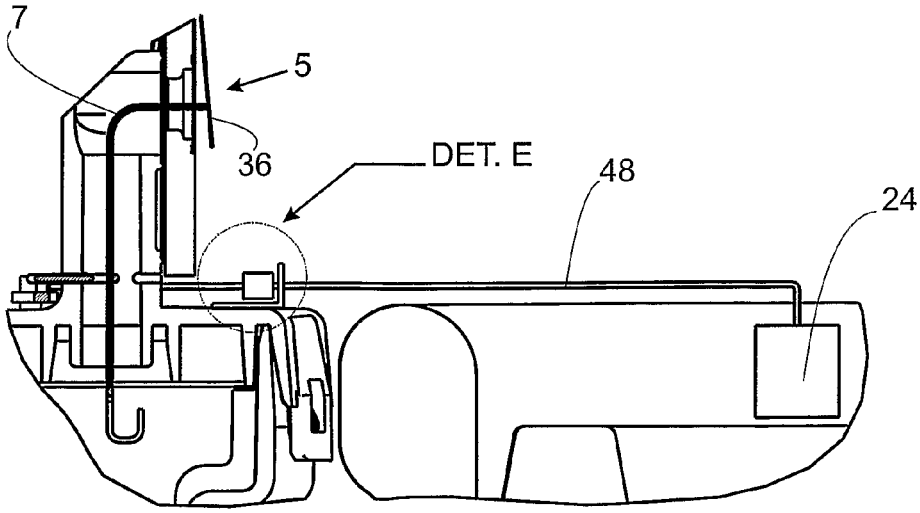
FIG. 9—represents an enlarged view of detail D indicated in FIG. 8.
Figure 10:
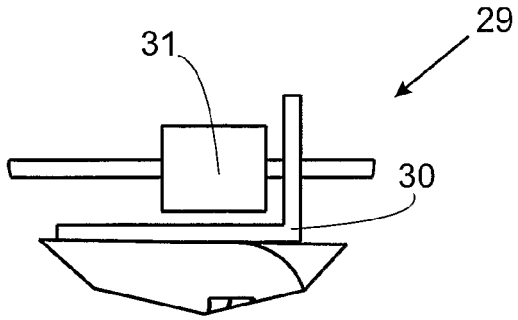
FIG. 10—represents an enlarged view of detail E indicated in FIG. 9.
Figure 11:
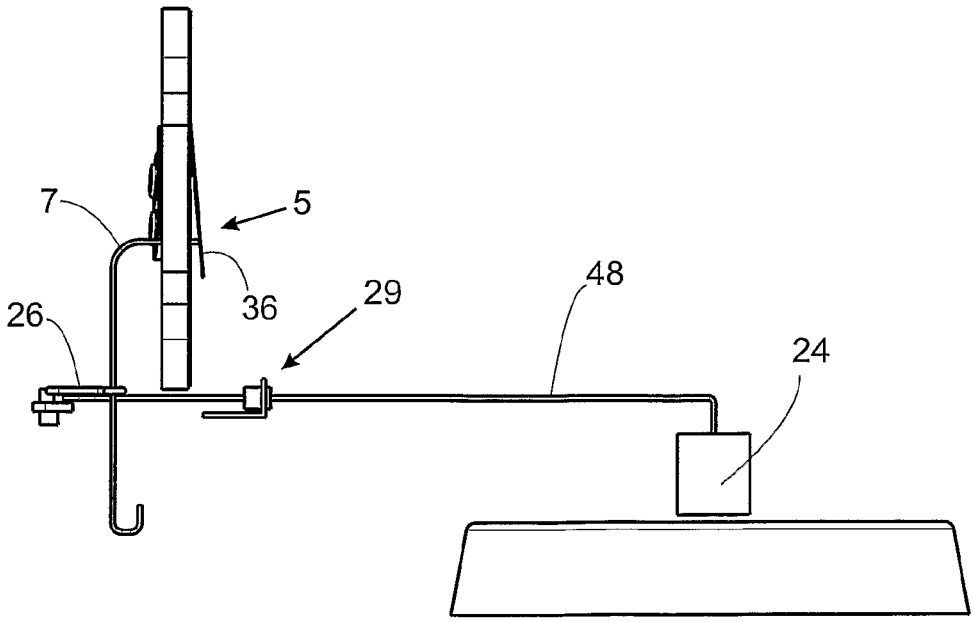
FIG. 11—is a simplified representation of the view illustrated in FIG. 9.

As it can be seen in FIG. 7, the elastic element 8, the semi-arch element 9 and the auxiliary element 18 are arranged over a support plate 19 capable of supporting the abovementioned elements.

The elastic element 8 has one first end 43 associated with a secondary shaft 21 which, in its turn, is operatively associated with the rotor 25 or shaft 33 of the electric motor 4. The secondary shaft 21 crosses a hole comprised by the support plate 19. Preferably, the elastic element 8 consists of a spring comprising a gauged elastic constant which is suitable for this application.

Figure 4:
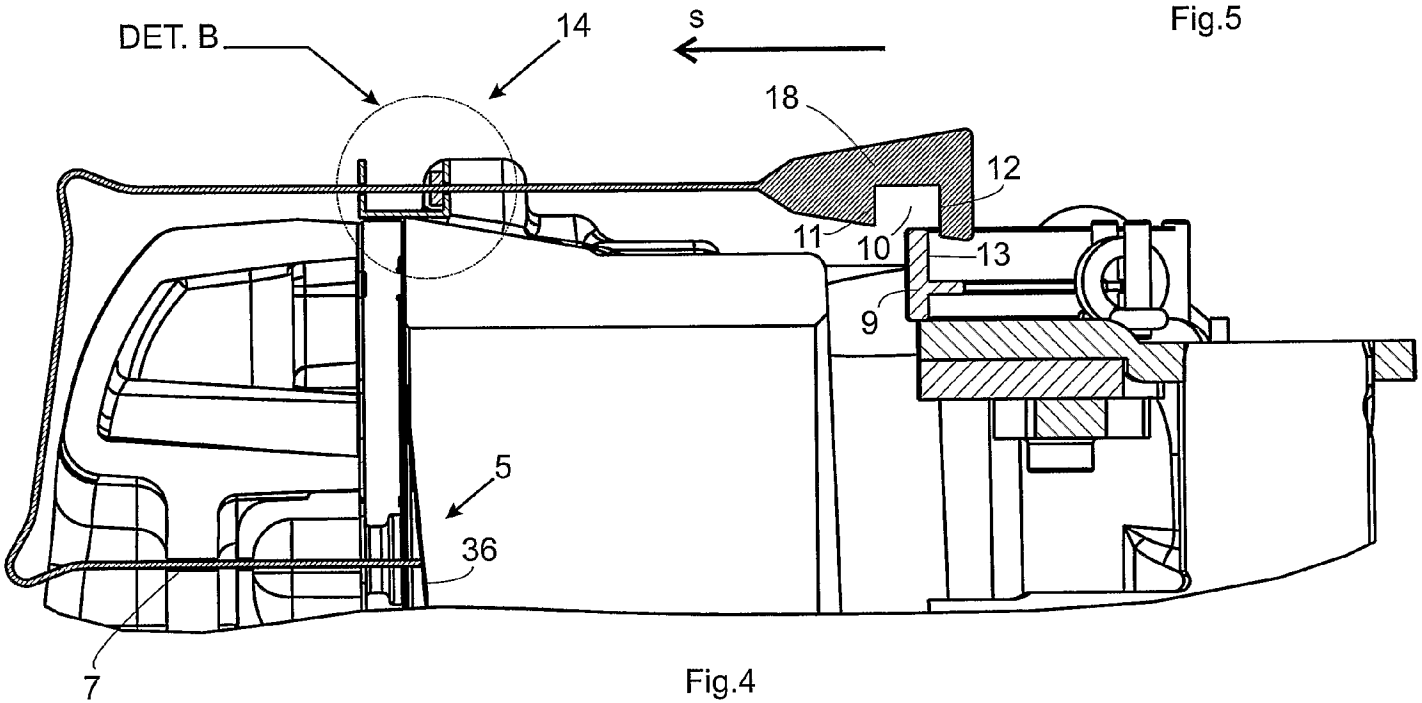
FIG. 4—represents an enlarged view of detail A indicated in FIG. 3.
Figure 6:
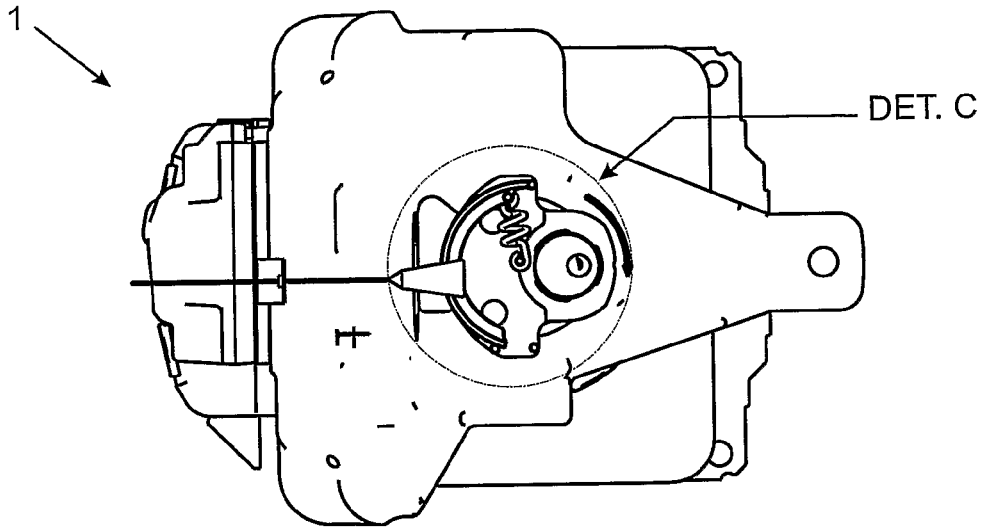
FIG. 6—represents an upper view of the gas compressor illustrated in FIG. 3.

As it can be seen in FIG. 4, the auxiliary element 18 has a "U" shaped cavity comprising an opening 10, a first side wall 11 and a second side wall 12. The auxiliary element 18 can be composed, for instance, of a plastic material.

Also according to FIG. 4, the semi-arch element 9 has at least one orthogonal projection 13 associable with the auxiliary element 18 by the opening 10. According to FIG. 7, the semi-arch element 9 has a first end 22 and a second end 23 capable of being jointed (hinged) over the support plate 19.

The elastic element 8 also has a second end 44 associated with the semi-arch element 9. Therefore, the elastic element 8 decompresses or compresses according to the speed of rotation of the rotor 25, so as to push or pull the semi-arch element 9 by the second end 44, which also moves angularly due to the rotation of the rotor 25 (arrow t of FIG. 7 indicates the direction of rotation of the rotor 25). This way, the semi-arch element 9 is capable of performing two simultaneous movements when the electric motor is driven 4: spinning movement (by rotation of the rotor 25) and axial radial movement (by decompressing/compressing of the elastic element 8), resulting in an angular movement that gets far from the secondary shaft 21, upon the decompression of the elastic element 8 or an angular movement which gets close to the secondary shaft 21 upon the compression of the elastic element 8. Because of this, this first embodiment is based on a centrifugal principle.

More specifically, the elastic element 8 is capable of decompressing upon the regime of work of the electric motor 4 to allow the movement of the semi-arch 9 in a first angular direction, which gets far from the secondary shaft 21. This movement of the semi-arch element 9 in the first angular direction allows an axial displacement of the auxiliary element 18 in a first axial direction (arrow s of FIG. 4 indicates the first axial direction of displacement), to pull the actuator element 7. In this situation, the orthogonal projection 13 of the semi-arch element 9 puts pressure (applies a force or a tension) on the first side wall 11 of the auxiliary element 18. Thus, under this condition, the admission valve 5 is released by the system to allow its operation according to the swing (back and forth) movement of the piston 3.

On the other hand, the elastic element 8 is capable of compressing when the electric motor 4 stops to allow the movement of the semi-arch element 9 in a second angular direction, opposite to the first angular direction. This movement of the semi-arch element 9 in the second angular direction allows the axial displacement of the auxiliary element 18 in a second axial direction, opposite to the first axial direction, to push the actuator element 7. In this situation, the orthogonal projection 13 of the semi-arch element 9 puts pressure (applies a force or a tension) on the second side wall 12 of the auxiliary element 18. Thus, under this condition, the admission valve 5 remains open (first plate 36 pressured in the sense of getting far from the first hole 35), thus allowing the gas to be admitted inside the cylinder 2 so as to avoid high pressure/temperature in the gas compressor 1.

It is worth noting that the elastic element 8 remains compressed until the start-up of the motor is required, when only then it will decompress.

Figure 5:
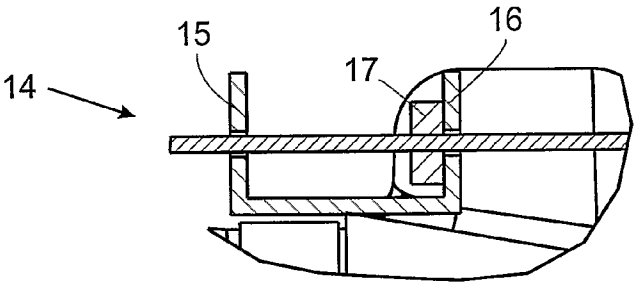
FIG. 5—represents an enlarged view of detail B indicated in FIG. 4.

The system also comprises a bistable device 14, illustrated in FIGS. 4 and 5, associated with the auxiliary element 18 and with the actuator element 7. Such bistable device 14, arranged between the auxiliary element 18 and the actuator element 7, comprises at least:

one first limiting element 15;

one second limiting element 16 substantially arranged in parallel with the first limiting element 15. Preferably, the first limiting element 15 and the second limiting element 16 integrate a metallic sheet/plate shaped as a single piece; and one bistable magnetic element 17 associable with the first limiting element 15 and with the second limiting element 16. Preferably, the bistable magnetic element 17 consists of a permanent magnet.

The bistable magnetic element 17 is stably associable with the first limiting element 15 to establish the end of the displacement of the auxiliary element 18 in the first axial direction. On the other hand, the bistable magnetic element 17 is stably associable with the second limiting element 16 to establish the end of the displacement of the auxiliary element 18 in the second axial direction. In both situations, the set formed by the elastic element 8, the semi-arch element 9 and the auxiliary element 18 remains stable.

Therefore, the main role of the bistable device 14 is to avoid fluctuations of the actuator element 7 (rod), keeping the stability of the system so that the admission valve 5 does not open or close at inappropriate moments, which can impair its performance and efficiency.

The system also comprises at least one bumper element 20 arranged over the support plate 19. Such bumper element 20 is associable with the first end 22 of the semi-arch element 9 to establish the end of the angular movement of the semi-arch element 9 in the second angular direction.

Second Preferred Embodiment

As it can be observed in FIGS. 8 to 13, in this second preferred embodiment, the system for actuation also comprises at least one first magnetic element for dragging 24 and a movable arm 26 operatively associated with each other. The movable arm 26 is also operatively associated with the actuator element 7 by means of a connecting rod 48. The first magnetic element for dragging 24 preferably consists of a permanent magnet.

More specifically, the movable arm 26 has a first end 27 operatively associated with the first magnetic element for dragging 24 capable of putting pressure on said first end 27. The movable arm 26 also has a second end 28, operatively associated with the actuator element 7, capable of putting pressure (applying a force or a tension) on the actuator element 7.

Figure 12:
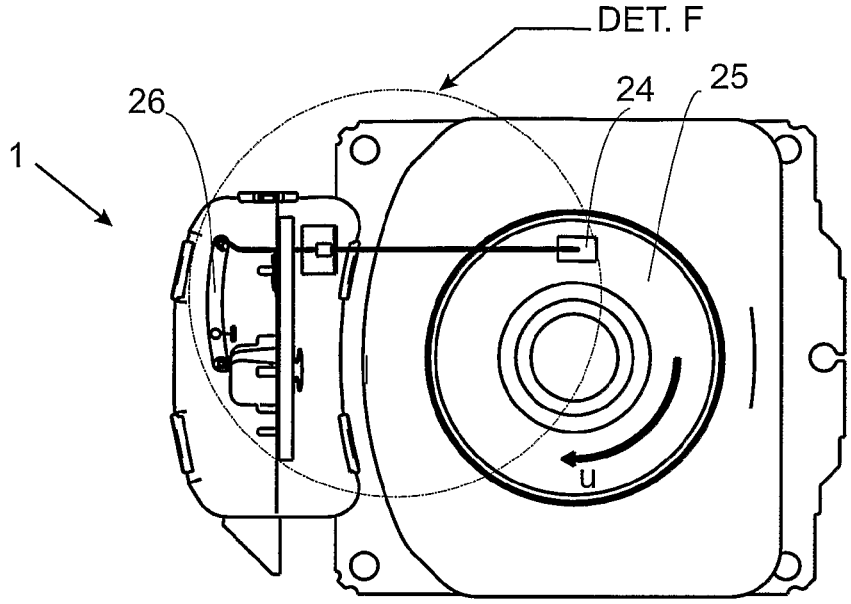
FIG. 12—represents an upper view of the system illustrated in FIG. 8.
Figure 13:
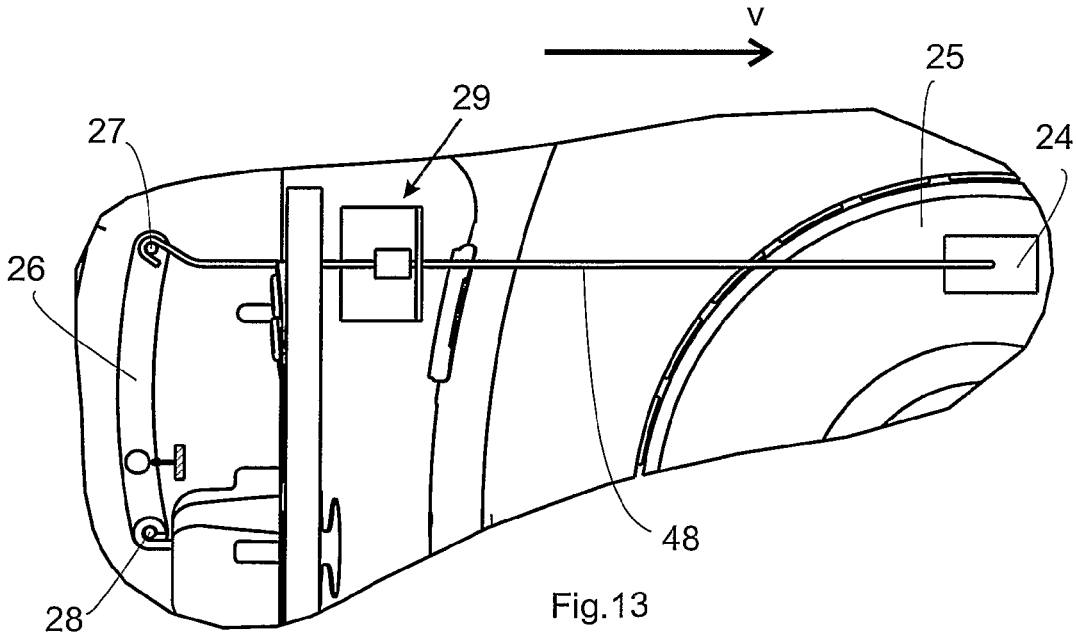
FIG. 13—represents an enlarged view of detail F indicated in FIG. 12.
Figure 14:
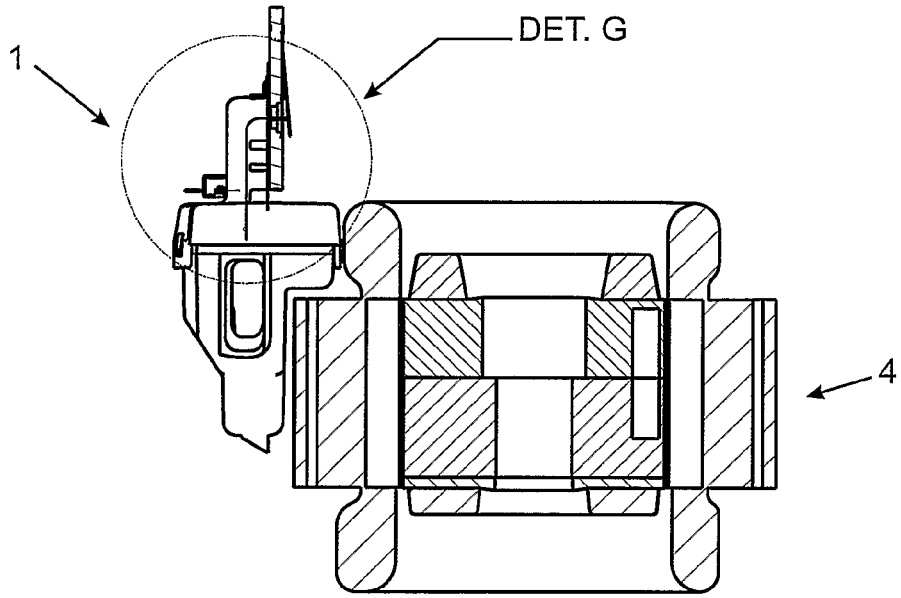
FIG. 14—represents a side sectional view of a gas compressor that comprises a system for actuation in its admission valve according to a third preferred embodiment of the present invention.
Figure 15:
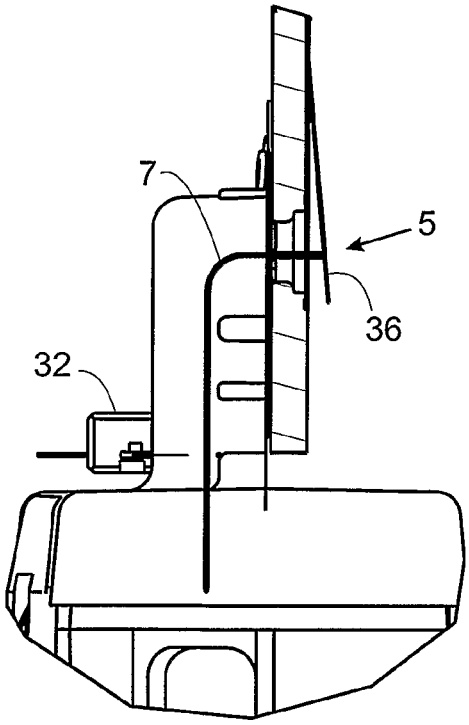
FIG. 15—represents an enlarged view of detail G indicated in FIG. 14.

The first magnetic element for dragging 24, operatively associated with the rotor 25 of the electric motor 4, is capable of axially moving in a first axial direction (arrow v of FIG. 13 indicates the first axial direction of displacement) upon the regime of work of the electric motor 4 (arrow u of FIG. 12 indicates the direction of rotation of the rotor 25). This displacement of the first magnetic element for dragging 24 in the first axial direction allows an angular movement of the movable arm 26 in a first angular direction to pull the actuator element 7. Thus, under this condition, the admission valve 5 is released by the system to allow its operation according to the swing (back and forth) movement of the piston 3.

On the other hand, the first magnetic element for dragging 24 is capable of axially moving in a second axial direction, opposite to the first axial direction, when the rotor 25 of the electric motor 4 stops. This displacement of the first magnetic element for dragging 24 in the second axial direction allows the angular movement of the movable arm 26 in a second angular direction, opposite to the first angular direction, to push the actuator element 7. Thus, under this condition, the admission valve 5 remains open (first plate 36 pressured in the direction of getting far from the first hole 35), thus allowing the return (admission) of the gas inside the cylinder 2 so as to avoid high pressure/temperature on the gas compressor 1.

Therefore, the second end 28 of the movable arm 26 axially moves in an opposite direction to the movement of the first end 27 of the movable arm 26, upon the displacement of the first magnetic element for dragging 24 in the first or second axial direction.

It is worth noting that the configuration of the first magnetic element for dragging 24, of the movable arm 26 and of the actuator element 7 upon the start-up of the gas compressor 1 is the same in relation to its stop, since the rotor 25 remains still, so as the actuator element 7 remains pushed.

The system also comprises a first monostable device 29 arranged between the first magnetic element for dragging 24 and the movable arm 26. This first monostable device 29 has at least one first top limiter 30 and one first magnetic monostable element 31 associable with each other. The first top limiter 30 consists of a metallic sheet or plate.

This first magnetic monostable element 31 is stably associable with the first top limiter 30 to establish the end of the displacement of the first magnetic element for dragging 24 in the first axial direction.

Similarly, the main role of the first monostable device 31 is the same of the bistable device 14 of the first preferred embodiment, that is, to avoid fluctuations of the actuator element 7 (rod), keeping the stability of the system so that the admission valve 4 does not open or close at inappropriate moments, which can impair its performance and efficiency.

Moreover, optionally, it would also be possible to use a bistable device similar to the one described in the first preferred embodiment of the present invention.

Third Preferred Embodiment

As it can be observed in FIGS. 14 to 19, in this third preferred embodiment, the system also comprises at least one first electro-mechanical element 32 operatively associable with a first element of electric drive (not indicated in the figures) and with the actuator element 7.

Preferably, the first electro-mechanical element 32 consists of an electromagnet capable of moving due to the generation of a magnetic field (magnetic effect), when an electric current is applied. Because of this movement, it is possible to put pressure (applying a force or a tension) on the actuator element 7 to a desired direction.

The first element of the electric drive preferably consists of a relay or a switch which allows the passage of electric current provided by a source of electric power. Said relay can be controlled through a digital, analog electric circuit, and even by a programmable unit such as a microcontroller/microprocessor.

The source of electric power can be a battery, a derivation of the feeding of the electric motor 4 (for instance, a motor stator), or any other type of source of electric feeding suitable for this application, capable of providing sufficient voltage/current to activate/deactivate the first electro-mechanical element 32 (electromagnet).

Figure 16:
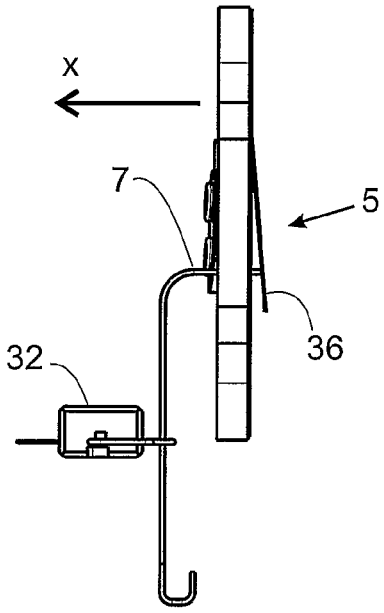
FIG. 16—is a simplified representation of the view illustrated in FIG. 15.
Figure 17:
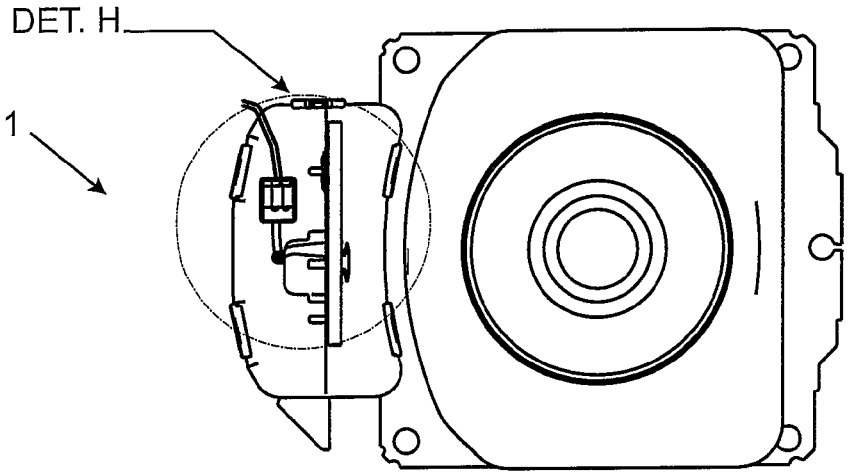
FIG. 17—represents an upper view of the system illustrated in FIG. 14.
Figure 18:
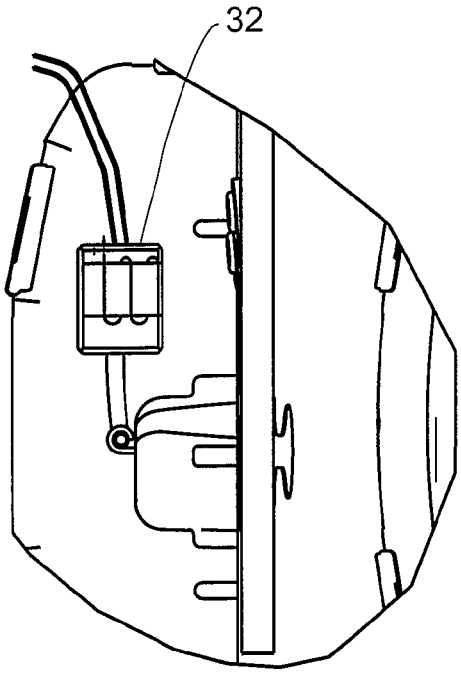
FIG. 18—represents an enlarged view of detail H indicated in FIG. 17.
Figure 19:
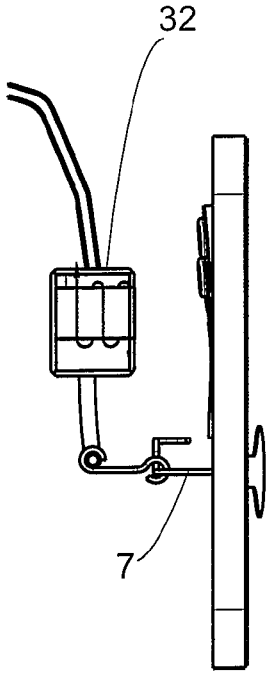
FIG. 19—is a simplified representation of the view illustrated in FIG. 18.
Figure 20:
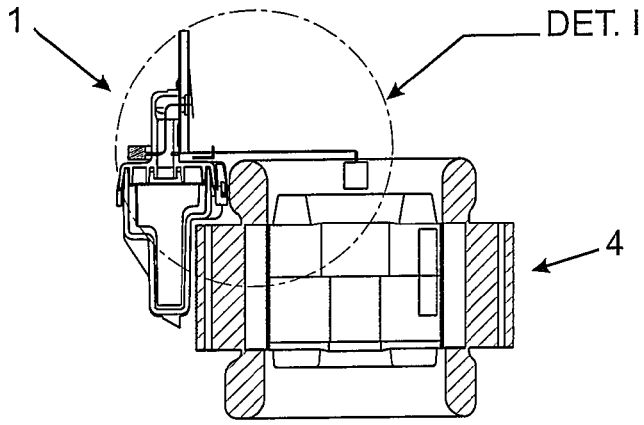
FIG. 20—represents a side sectional view of a gas compressor that comprises a system for actuation in its admission valve according to a fourth preferred embodiment of the present invention.
Figure 21:
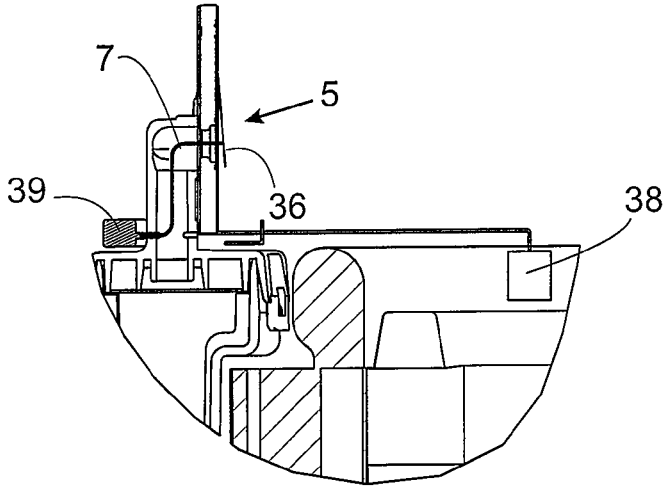
FIG. 21—represents an enlarged view of detail I indicated in FIG. 20.
Figure 22:
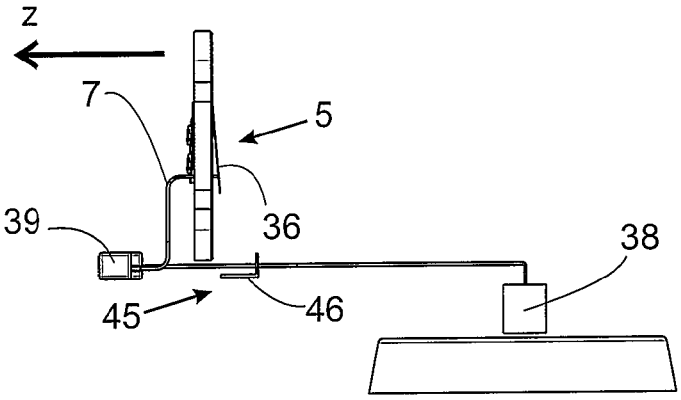
FIG. 22—is a simplified representation of the view illustrated in FIG. 21.
Figure 23:
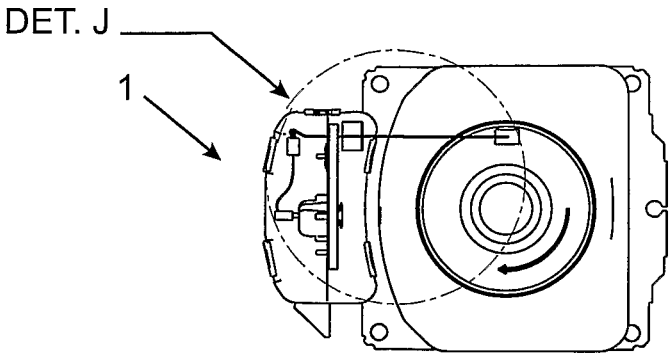
FIG. 23—represents an upper view of the system illustrated in FIG. 20.
Figure 24:
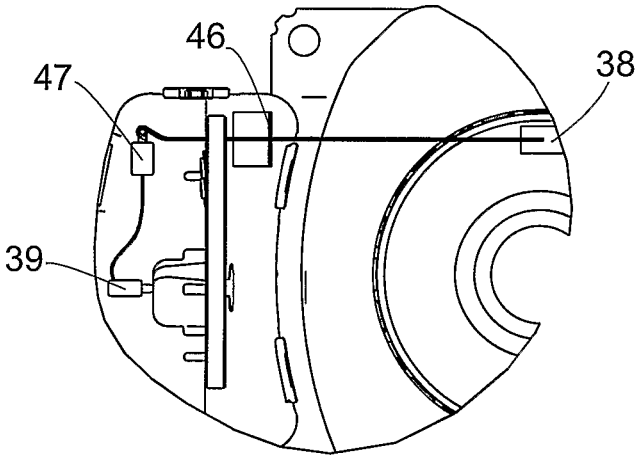
FIG. 24—represents an enlarged view of detail J indicated in FIG. 23.
Figure 25:
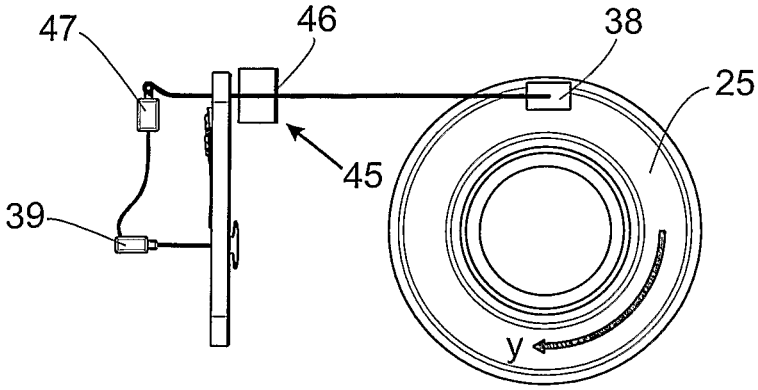
FIG. 25—is a simplified representation of the view illustrated in FIG. 24.

The first electro-mechanical element 32 is capable of axially moving in a first axial direction upon the deactivation of the first element of electric drive (open relay) to pull the actuator element 7 (arrow x of FIG. 16 indicates the first axial direction of displacement). Thus, under this condition, the admission valve 5 is released by the system to allow its operation according to the swing (back and forth) movement of the piston 3.

On the other hand, the first electro-mechanical element 32 is capable of axially moving in a second axial direction, opposite to the first axial direction, upon the activation of the first element of electric drive (closed relay) to push the actuator element 7. Thus, under this condition, the admission valve 5 remains open (first plate 36 pressured in the direction of getting far from the first hole 35), thus allowing the gas to be admitted inside the cylinder 2 so as to avoid high pressure/temperature on the gas compressor 1.

Fourth Preferred Embodiment

In general terms, the fourth preferred embodiment consists of a combination of the second and third preferred embodiments described above.

This way, in this fourth preferred embodiment, represented in FIGS. 20 to 25, the system for actuation also comprises at least one second magnetic element for dragging 38, one second element of electric drive 47 and one second electro-mechanical element 39 which are all operatively associated with each other. Besides, the second magnetic element for dragging 38 is operatively associated with the rotor 25 of the electric motor 4. Also, the second electro-mechanical element 39 is operatively associated with the actuator element 7. The second magnetic element for dragging 38 preferably consists of a permanent magnet.

Preferably, the second electro-mechanical element 39 consists of an electromagnet capable of moving due to the generation of a magnetic field, when electric current is applied. Because of this movement, it is possible to put pressure (applying a force or a tension) on the actuator element 7 to a desired direction.

The second element of the electric drive 47 preferably consists of a relay or a switch which allows the passage of electric current provided by a source of electric power. Said relay can be controlled through a digital, analog electric circuit, and even by a programmable unit such as a microcontroller/microprocessor.

The source of electric power can be a battery, a derivation of the feeding of the electric motor 4 (for instance, a motor stator), or any other type of source of electric feeding suitable for this application, capable of providing sufficient tension/current to activate/deactivate the second electromechanical element 39 (electromagnet).

The second magnetic element for dragging 38 is capable of axially moving in a first axial direction upon the regime of work of the electric motor 4 (arrow y of FIG. 25 indicates the direction of rotation of the rotor 25) to activate the second element of electric drive (closing the relay). This activation of the second element of electric drive 47 allows an axial displacement of the second electro-mechanical element 39 in a first axial direction to pull the actuator element 7 (arrow z of FIG. 22 indicates the first axial direction of displacement). Thus, under this condition, the admission valve 5 is released by the system to allow its operation according to the swing (back and fourth) movement of the piston 3.

On the other hand, the second magnetic element for dragging 38 is capable of axially moving in a second axial direction, opposite to the first axial direction, when the rotor 25 of the electric motor 4 stops, to deactivate the second element of electric drive 47 (open the relay). This deactivation of the second element of electric drive 47 allows an axial displacement of the second electro-mechanical element 39 in a second axial direction, opposite to the first axial direction, to push the actuator element 7. Thus, under this condition, the admission valve 5 remains open (first plate 36 pressured in the direction of getting far from the first hole 35), thus allowing the gas to be admitted inside the cylinder 2 so as to avoid high pressure/temperature on the gas compressor 1.

It is worth noting that the configuration of the second magnetic element for dragging 38, of the second electro-mechanical element 39 and of the actuator element 7 upon the start-up of the gas compressor 1 is the same in relation to its stop, once the rotor 25 remains still, so as the actuator element 7 remains pushed.

This way, the second element of electric drive 47 operates inversely to the first element of electric drive of the third preferred embodiment described above, that is, the actuator element 7 (rod) in the fourth preferred embodiment is pushed upon the deactivation of the second element of electric drive 47 whereas the actuator element 7 (rod) in the third preferred embodiment is pushed upon the activation of the first element of drive.

The system may also comprise a second monostable device 45 arranged between the second magnetic element for dragging 38 and the second electro-mechanical element 39. This second monostable device has at least one second top limiter 46 and one second magnetic monostable element (not illustrated, but similar to the first monostable device) associable with each other. The second top limiter 46 consists of a metallic sheet or plate.

This second magnetic monostable element is stably associable with the second top limiter 46 to establish the end of the displacement of the second magnetic element for dragging 38 in the first axial direction.

The main role of the monostable device 31 is to avoid fluctuations of the actuator element 7 (rod), keeping the stability of the system so that the admission valve 4 does not open or close at inappropriate moments, which can impair its performance and efficiency.

Optionally, it would also be possible to use a bistable device similar to the one described in the first preferred embodiment of the present invention.

Another object of the present invention is a gas compressor 1 which comprises the system for actuation described above.

Also another object of the present invention is a refrigeration equipment having a gas compressor 1 which comprises the system for actuation described above. Said refrigeration equipment consists, for instance, of an industrial/commercial/domestic refrigerator, freezer or an air-conditioning device.

After describing examples of preferred embodiments, it shall be understood that the scope of the present invention encompasses other possible variations, being limited only by the contents of the attached claims, where the possible equivalents are included.

The invention claimed is:

1. System for actuation in an admission valve of a gas compressor, the gas compressor comprising at least:

one set formed by a cylinder and a piston;

one electric motor operatively associated with said set, the electric motor being capable of providing an axial movement of the piston to compress the gas inside the cylinder, the admission valve being configured to allow the input of gas inside the cylinder upon the axial movement of the piston in a first axial direction;

one discharge valve configured to allow the output of gas from inside the cylinder upon the axial movement of the piston in a second axial direction, opposite to the first axial direction, one actuator element operatively associated with the admission valve, the system comprising at least:

one first main movable magnetic element magnetically associated with a rotor of the electric motor, and one second main movable element operatively associated with the first main movable magnetic element, the second main movable element further being mechanically associated with the actuator element, the first main movable magnetic element and the second main movable element being configured to interact to each other to keep the admission valve open when the electric motor stops and starts-up and further to allow opening and closing of the admission valve upon the regime of work of the electric motor.

2. System according to claim 1, wherein the first main movable magnetic element is a permanent magnet.

3. System according to claim 1, wherein further comprising a monostable device arranged between the first main movable magnetic element and the second main movable element, the monostable device comprising at least:

one top limiter;

one magnetic monostable element associable with the top limiter, wherein the magnetic monostable element is stably associable with the top limiter to establish the end of the displacement of the first main movable magnetic element in the first axial direction.

4. System for actuation in an admission valve of a gas compressor, the gas compressor comprising at least:

one set formed by a cylinder and a piston;

one electric motor operatively associated with said set, the electric motor being capable of providing an axial movement of the piston to compress the gas inside the cylinder, the admission valve being configured to allow the input of gas inside the cylinder upon the axial movement of the piston in a first axial direction;

one discharge valve configured to allow the output of gas from inside the cylinder upon the axial movement of the piston in a second axial direction, opposite to the first axial direction, one actuator element operatively associated with the admission valve, the actuator element being capable of keeping the admission valve open when the electric motor stops and starts-up, the actuator element being further capable of allowing opening and closing of the admission valve upon the regime of work of the electric motor, the system comprising at least:

one magnetic element for dragging mechanically associated with an element of electric drive, the magnetic element for dragging further being and magnetically associated with a rotor of the electric motor, the magnetic element for dragging being capable of axially moving in a first axial direction upon the regime of work of the electric motor to activate the element of electric drive, the magnetic element for dragging being capable of axially moving in a second axial direction, opposite to the first axial direction, upon the stop of the rotor of the electric motor) to deactivate the element of electric drive; and one electro-mechanical element electrically associated with the element of electric drive, the electro-mechanical element further being mechanically associated with the actuator element, the electro-mechanical element being capable of axially moving in a first axial direction, upon the activation of the element of electric drive, to pull the actuator element, the electro-mechanical element being capable of axially moving in a second axial direction, opposite to the first axial direction, upon the deactivation of the element of electric drive, to push the actuator element.

5. System according to claim 4, wherein magnetic element for dragging is a permanent magnet.

6. System according to claim 4, further comprising a monostable device arranged between the magnetic element for dragging and the electro-mechanical element, the monostable device comprising at least:

one top limiter;

one magnetic monostable element associable with the top limiter, wherein the magnetic monostable element is stably associable with the top limiter to establish the end of the displacement of the magnetic element for dragging in the first axial direction.

* * * * *